US006161229A

United States Patent [19]

Ryan et al.

[11] Patent Number: 6,161,229

[45] Date of Patent: Dec. 19, 2000

[54] POWERED LIFT TOILET SEAT WITH ARMRESTS

[75] Inventors: Leon M. Ryan, Magnolia, Ark.; Charles K. Dorland, The Woodlands, Tex.; Eldridge P. Douglass, Little Rock, Ark.

[73] Assignee: Assist Healthcare, LLC, Little Rock, Ark.

[21] Appl. No.: 09/431,528

[22] Filed: Nov. 1, 1999

[51] Int. Cl.[7] ..... A47K 13/10

[52] U.S. Cl. ..... 4/667; 4/246.1; 4/246.4; 297/DIG. 10

[58] Field of Search ..... 4/667, 246.1, 246.4, 4/254, 480, 246.3, 246.5; 297/DIG. 10, 327, 330

[56] References Cited

U.S. PATENT DOCUMENTS

| | | |
|---|---|---|
| 1,399,744 | 12/1921 | Brophy . |
| 2,200,687 | 5/1940 | Bercot . |
| 2,219,044 | 3/1940 | Horr . |

(List continued on next page.)

FOREIGN PATENT DOCUMENTS

| | | |
|---|---|---|
| 57543 | 8/1982 | European Pat. Off. . |
| 1554583 | 6/1966 | Germany . |
| 2625046 | 6/1976 | Germany . |
| 4215448 | 5/1992 | Germany . |
| 6717278 | 12/1967 | Netherlands . |
| 1150379 | 4/1969 | United Kingdom . |
| 2149294 | 6/1985 | United Kingdom . |
| 9207498 | 5/1992 | WIPO . |
| 9311692 | 6/1993 | WIPO . |

*Primary Examiner*—Henry J. Recla
*Assistant Examiner*—Khoa Huynh
*Attorney, Agent, or Firm*—Mark A. Rogers; Gary N. Speed

[57] ABSTRACT

An apparatus is disclosed having a frame, front and rear guides rigidly secured to the frame and having front and rear channels passing therethrough, angling rearwardly from top to bottom. A toilet seat is operably connected to the frame and is movable between a lowered position and a raised position. A driver is operably connected to the toilet seat to move the seat between the lowered and raised positions. An armrest is provided, the armrest having front and rear members slidably passing through the front and rear channels of the front and rear guides, respectively. The front and rear armrest members are operably connected to the driver for moving them through the front and rear channels as the armrest moves between a lowered position and a raised position. The armrest may be operably connected to the driver so that a top portion of the armrest remains in a substantially horizontal position as the armrest moves between the lowered position and the raised position. The armrest may also be operably connected to the driver by a linkage having a first member rigidly secured to lower portions of the front and rear armrest members, a second member pivotally secured to the first member and operably connected to the toilet seat for pivotal motion relative to the toilet seat, and a third member pivotally secured to the first member and operably connected to the driver for pivotal motion relative to the driver.

18 Claims, 9 Drawing Sheets

U.S. PATENT DOCUMENTS 2,641,305 6/1953 Oishei .
2,869,623 1/1959 Poulin .
2,986,745 6/1961 Melzassard .
3,138,402 6/1964 Heyl, Jr. et al. .
3,250,569 5/1966 Gaffney .
3,473,174 10/1969 Cool .
3,479,086 11/1969 Sheridan .
3,915,494 10/1975 Somerset ..... 297/DIG. 10
3,925,833 12/1975 Hunter .
4,034,426 7/1977 Hardwick et al. .
4,185,335 1/1980 Alvis .
4,249,774 2/1981 Andreasson .
4,453,766 6/1984 DiVito .
4,581,778 4/1986 Pontoppidan .
4,587,678 5/1986 Love et al. .
4,786,107 11/1988 Crockett .
4,833,736 5/1989 Sadler et al. .
4,850,645 7/1989 Crockett .
4,884,841 12/1989 Holley .
4,907,303 3/1990 Baird ..... 4/667
4,938,533 7/1990 Thielois .
4,946,222 8/1990 Matson .
4,949,408 8/1990 Trkla .
4,993,085 2/1991 Gibbons .
4,993,777 2/1991 LaPointe .
5,063,617 11/1991 Ward et al. .
5,142,709 9/1992 McGuire .
5,155,873 10/1992 Bridges .
5,189,739 3/1993 Thierry .
5,280,654 1/1994 Wolfer .
5,294,179 3/1994 Rudes et al. .
5,309,583 5/1994 White et al. .
5,312,157 5/1994 Logan, Jr. .
5,323,497 6/1994 Lih et al. .
5,333,931 8/1994 Weddendorf .
5,346,280 9/1994 Deumite .
5,440,767 8/1995 Bergenwall .
5,444,877 8/1995 Kumarasurier .
5,561,872 10/1996 Phillips .
5,588,162 12/1996 Robinson .
5,626,389 5/1997 Logan, Jr. .
5,641,201 6/1997 Casey et al. .
5,661,858 9/1997 House et al. .
5,737,780 4/1998 Okita et al. .
5,819,325 10/1998 Richards .
5,848,447 12/1998 Lindsay .

POWERED LIFT TOILET SEAT WITH ARMRESTS

BACKGROUND OF THE INVENTION

This invention relates to a powered lift toilet seat, and more particularly, to such an apparatus with an improved moving armrest.

Powered lift toilet seats are known in the art. It is likewise known in the art to provide a powered lift toilet seat with armrests that move. Examples of such equipment include U.S. Pat. Nos. 4,993,085 and 5,309,583, the disclosures of which are incorporated herein by reference as if set forth fully herein. Such attempts provided generally acceptable means of assisting elderly or disabled persons in moving between a standing and sitting position. Still, the pieces of equipment disclosed suffered from shortcomings. For example, the apparatus disclosed in U.S. Pat. No. 4,993,085, issued to Gibbons in 1991, uses an overly complex and cumbersome water powered apparatus. In contrast, the apparatus disclosed in U.S. Pat. No. 5,309,583, issued to Johnny White et al. in 1994, discloses a less complex, less cumbersome apparatus that offers a number of advantages. Still, the apparatus disclosed in White et al. has a few shortcomings. For example, for cleaning purposes and for maintaining a sanitary toilet in general, it is undesirable to have open longitudinal channels, particularly on an upper surface of the apparatus in such close proximity to the toilet seat. Also, efforts to provide arcuate movement of the armrests result in the use of overly complex mechanisms that add to the cost and complexity of the system and that make manufacturing more difficult. The alignment of the shield and seat relative to the frame also creates a risk of pinching a user's fingers or hands if the user improperly grasps the shield instead of the armrests as the shield and seat are lowered. The shape of the armrests and manner of attaching the armrests to the unit also makes wiring of electrical components difficult and limits the flexibility of a user to place the actuating switch on either armrest as desired or to reposition the switch on location. Further, the incorporation of the pivot blocks as integral parts of the frame make it difficult to repair units after any problems develop at these crucial, weight-bearing pivot points. Further still, using angled legs leads to undesirable frame deflections that can create problems, particularly when casters or rollers are used.

SUMMARY OF THE INVENTION

It is therefore an object of the present invention to provide a powered lift toilet seat of the above type having improved armrests.

It is a further object of the present invention to provide an apparatus of the above type having improved mechanical linkages for moving the armrests.

It is a further object of the present invention to provide an apparatus of the above type that is easier to manufacture, ship, clean, and maintain.

It is a still further object of the present invention to provide an apparatus of the above type that offers more flexibility in set-up and maintenance.

It is a still further object of the present invention to provide an apparatus of the above type that reduces the risk of injury during use.

It is a still further object of the present invention to provide an apparatus of the above type that offers an improved, more flexible, more easily manufactured, more easily shipped, more easily assembled, and more durable manner of attaching and moving an armrest relative to a frame.

It is a still further object of the present invention to provide an apparatus of the above type with improved wiring of power components offering making it easier to manufacture, assemble, and modify, and offering greater flexibility in placement of activation switches.

Toward the fulfillment of these and other objects and advantages, the apparatus of the present invention comprises a frame, front and rear guides rigidly secured to the frame and having front and rear channels passing therethrough, angling rearwardly from top to bottom. A toilet seat is operably connected to the frame and is movable between a lowered position and a raised position. A driver is operably connected to the toilet seat to move the seat between the lowered and raised positions. At least one armrest is provided, the armrest having front and rear members slidably passing through the front and rear channels of the front and rear guides, respectively. The front and rear armrest members are operably connected to the driver for moving the front and rear armrest members through the front and rear channels as the toilet seat moves between the lowered and raised position. The armrest may be operably connected to the driver so that a top portion of the armrest remains in a substantially horizontal position as the armrest moves between a lowered and raised position. The armrest may also be operably connected to the driver by a linkage having a first member rigidly secured to lower portions of the front and rear armrest members, a second member pivotally secured to the first member and pivotally secured to the toilet seat, and a third member pivotally secured to the first member and pivotally secured to the driver.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings, wherein.

DETAILED DESCRIPTION OF THE PREFERRED EMBODIMENT

Figure 1:
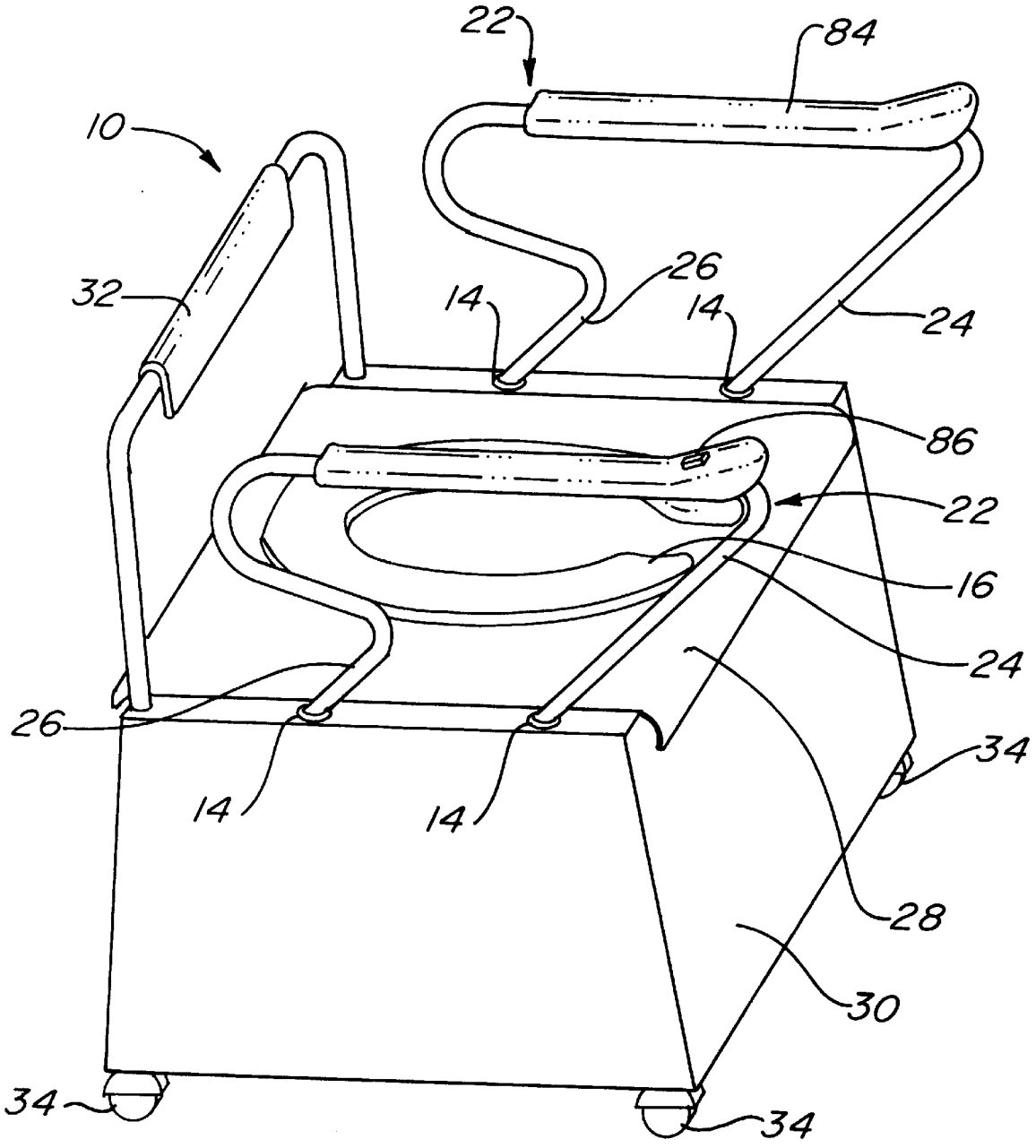
FIG. 1 is a perspective view of a powered lift toilet seat of the present invention.

Referring to FIG. 1, the reference numeral 10 refers in general to a powered lift toilet seat apparatus of the present invention. The apparatus 10 has a frame 12, front and rear guides 14, a toilet seat 16, a driver 20, and one or more armrests 22, each armrest having front and rear members 24 and 26. The apparatus 10 may be provided with a shield 28, a shroud 30, a backrest 32, and adjustable casters or rollers 34.

Figure 2:
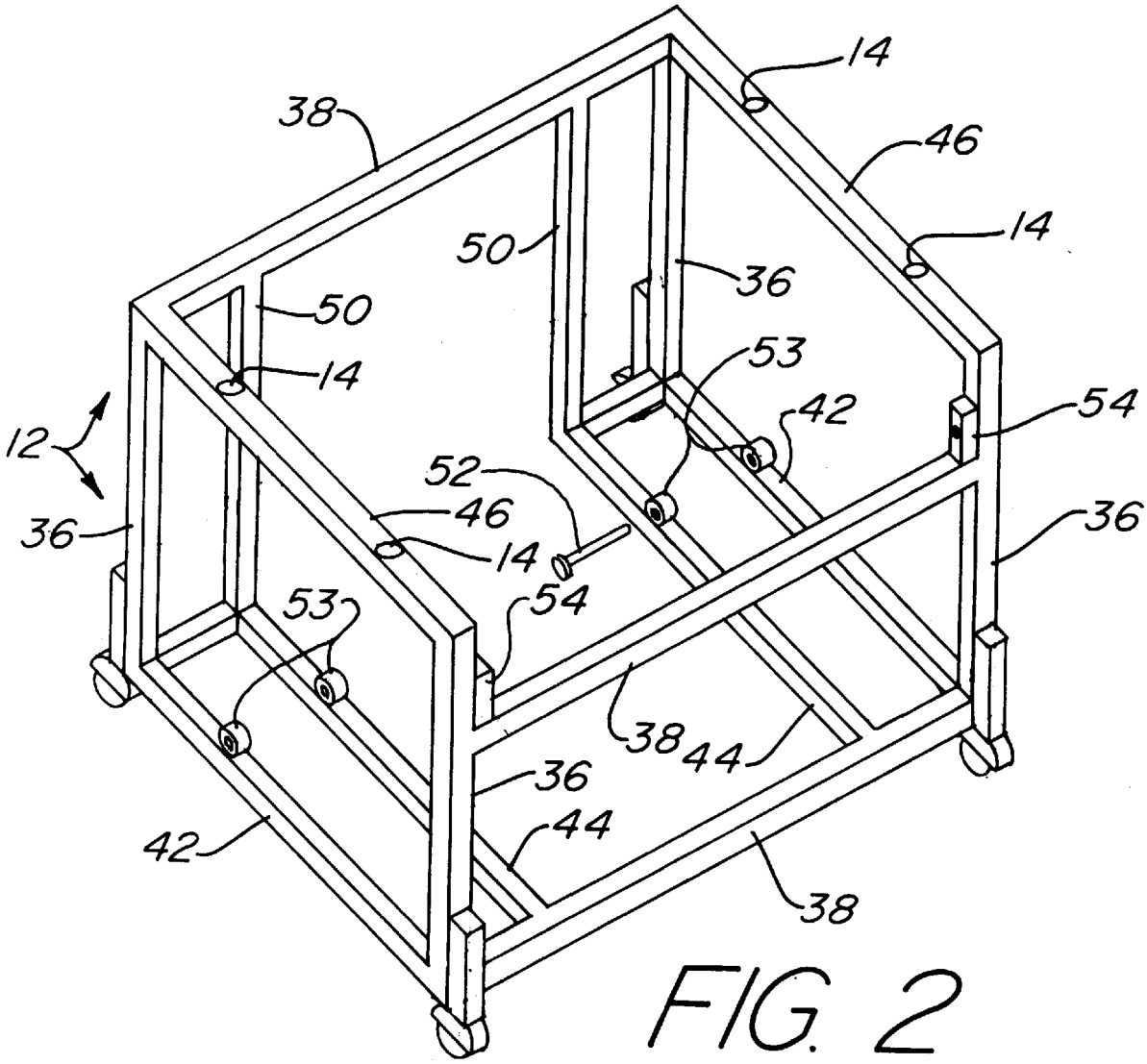
FIG. 2 is a partially exploded perspective view of a frame of the present invention.
Figure 4:
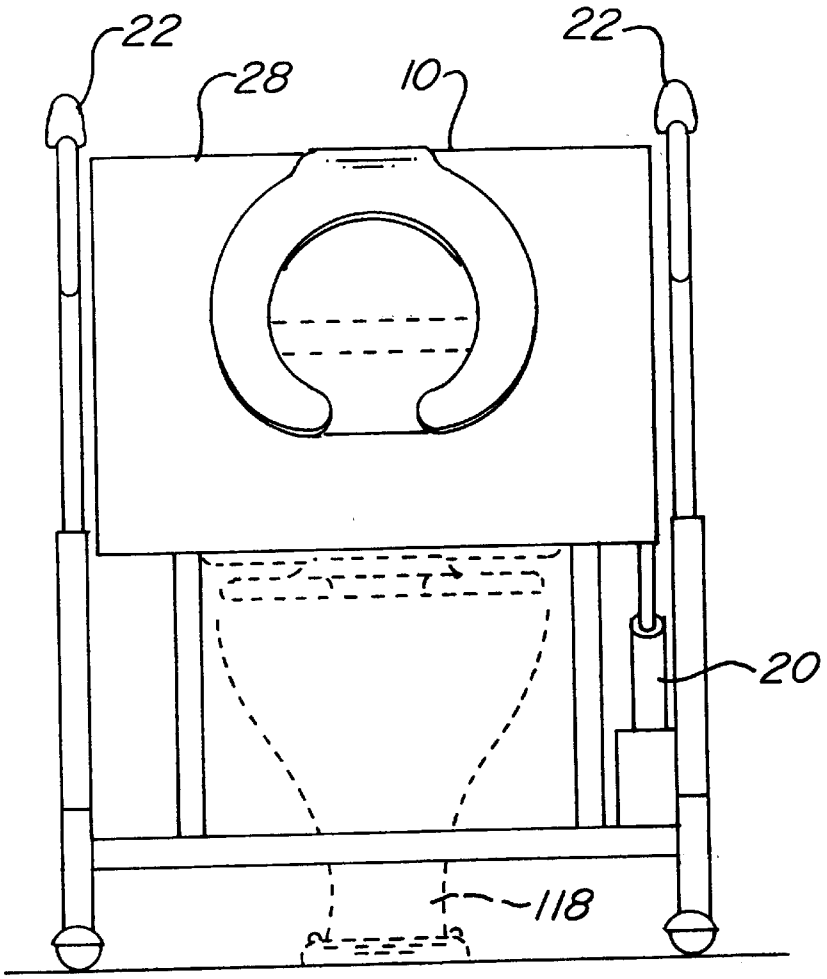
FIG. 4 is a front elevation view of the present invention in a raised position over a toilet bowl.
Figure 3:
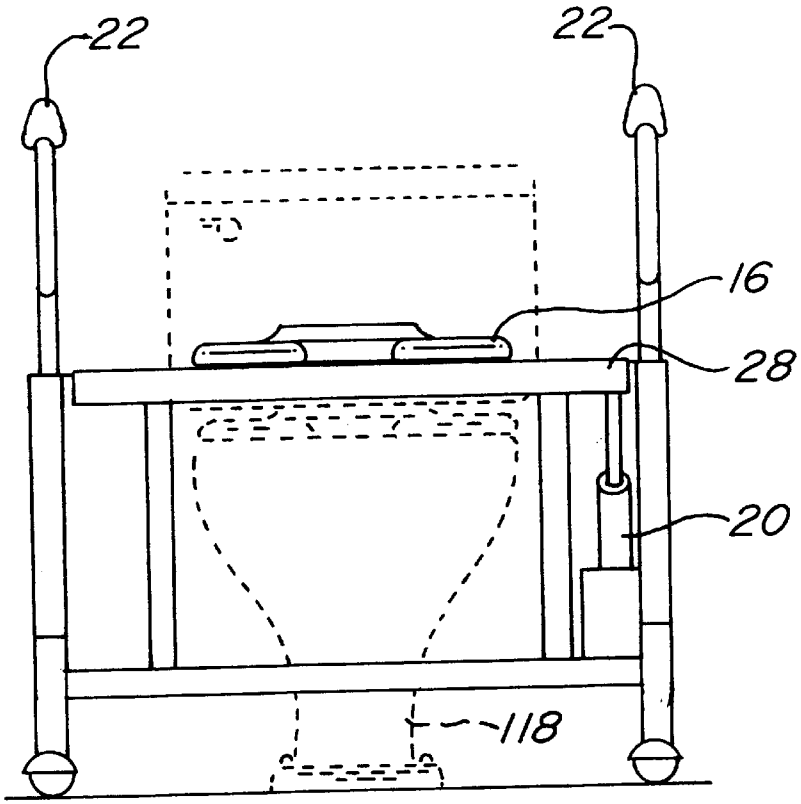
FIG. 3 is a front elevation view of the present invention in a lowered position over a toilet bowl.
Figure 5:
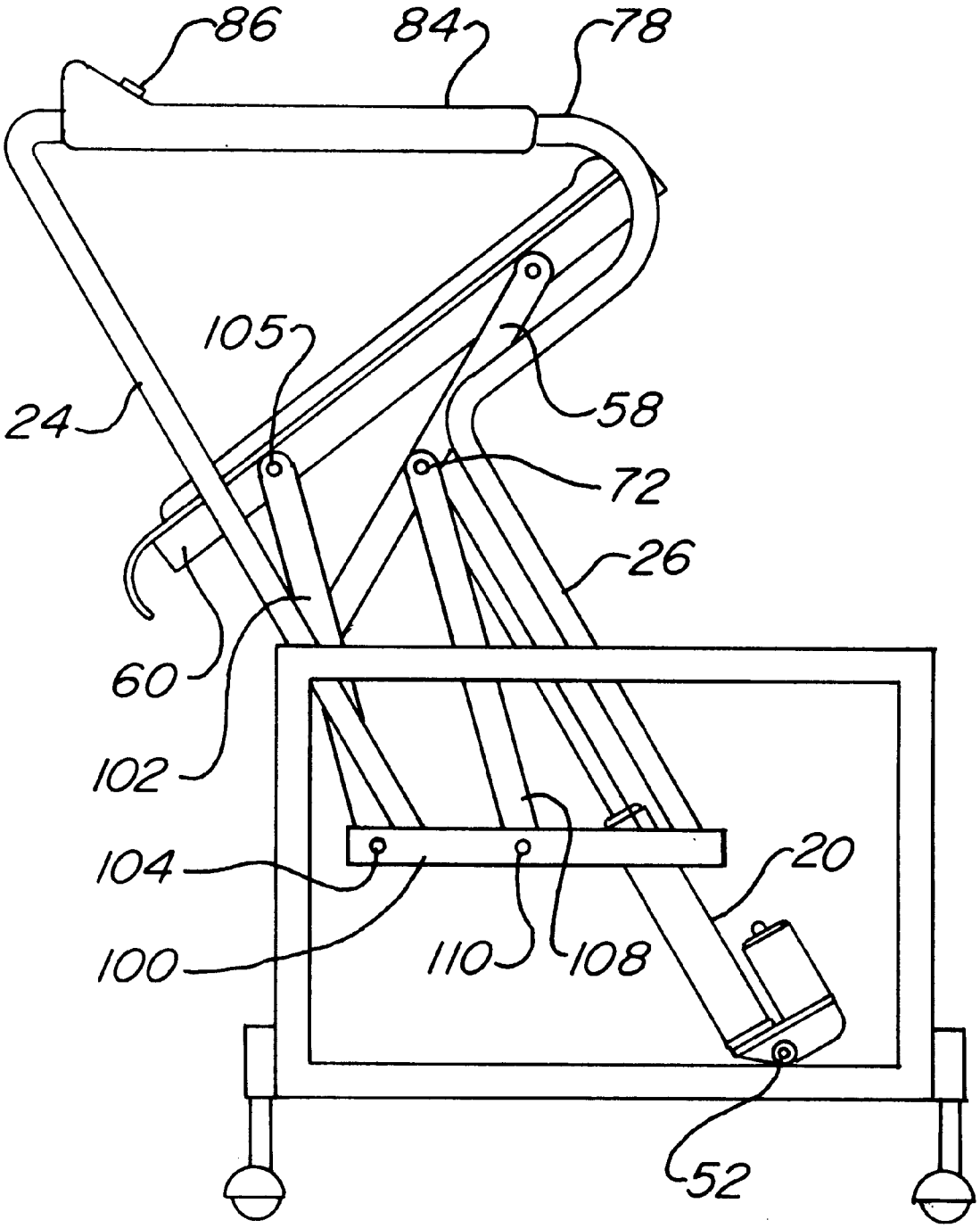
FIG. 5 is a partially exploded elevation view of the left side of the present invention in a raised position.
Figure 6:
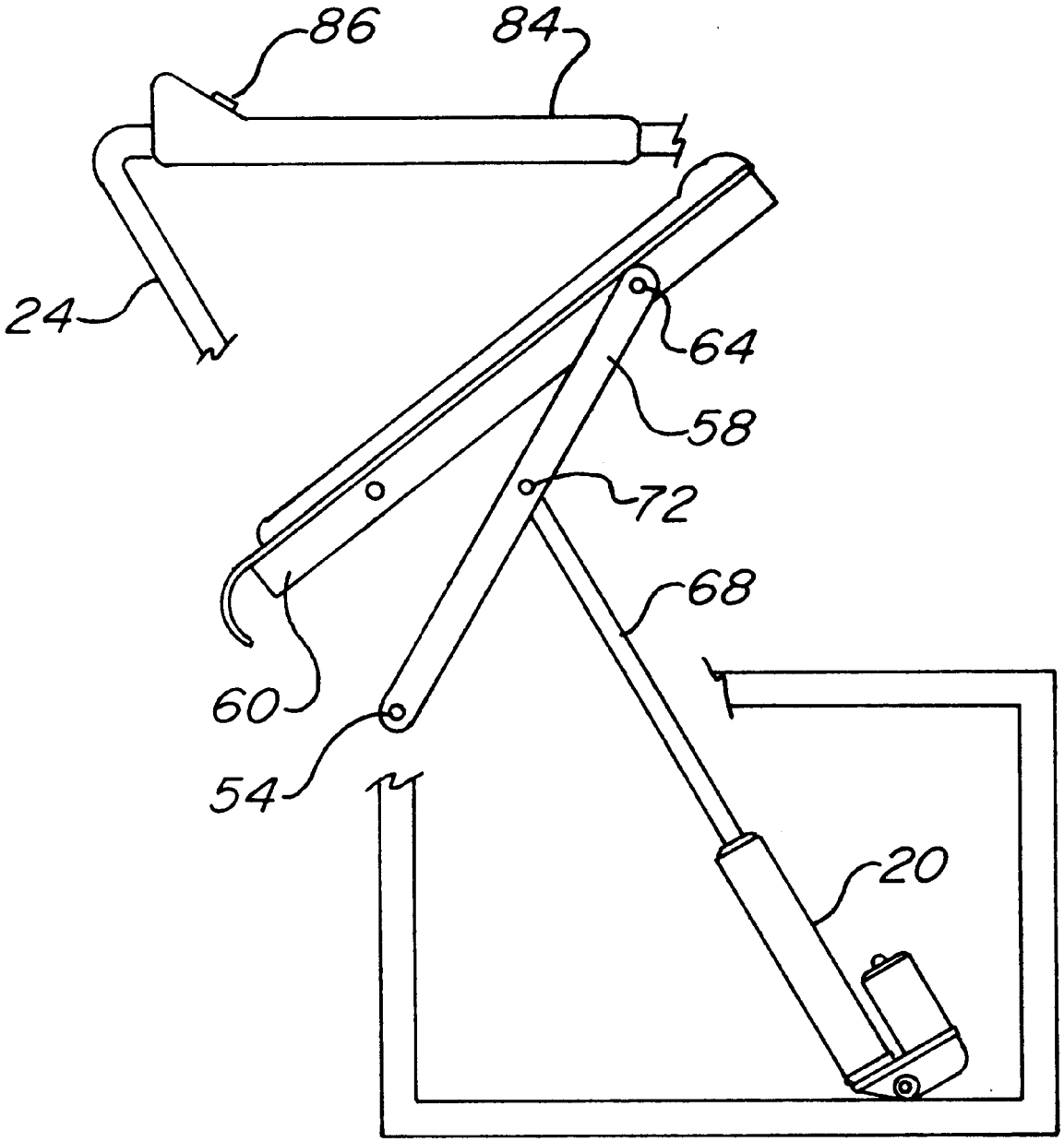
FIG. 6 is a partial left side elevation view showing a driver operably connected to a toilet seat in a raised position.

Referring to FIG. 2, the frame 12 has an upright member 36 at each corner, which may serve as a leg or as a point of attachment for an adjustable caster or roller, preferably a locking swivel caster. The upright members 36 are preferably substantially vertical. Angled upright members may of course be used, but using angled upright members as legs leads to undesirable frame deflections that can create problems, particularly when casters or rollers are used. Transverse braces 38 connect upright members 36 and provide strength and stability to the apparatus 10. Shortened transverse braces 40 are used at the back of the frame 12 to permit the frame to be easily positioned over a toilet bowl. Lower external longitudinal braces 42 and lower internal longitudinal braces 44 also extend between upright members 36. Each upper longitudinal brace 46 is provided with front and rear guides 14 which are rigidly secured to the upper longitudinal brace 46 at an upward angle from back to front so that the guides pass through an upper face of the longitudinal brace 46 at a point forward of where the guide passes through a lower face of the longitudinal brace. The guides 14 preferably pass through holes drilled, punched, or formed in each longitudinal brace 46 and are rigidly secured to the each longitudinal brace 46 such as by welding. Internal upright members 50 are provided at the back of the frame 12 connecting the internal longitudinal braces 44 with the shortened transverse braces 40 and the upper rear transverse brace. The shroud assembly 30 and backrest 32 may be affixed to the frame 12. The shroud assembly 30 may be connected to the frame 12 at the top and to the caster assembly 34 at the bottom so that it has surfaces that slope slightly outward from top to bottom.

Two pivot points are located on at least one side of the frame 12. The first pivot point is at a pin 52 which passes between retaining members 53 which are rigidly affixed to the lower inner and external longitudinal members 42 and 44 at an intermediate position. Pin 52 provides a pivotal point of attachment for driver 20. In the preferred embodiment, only one driver 20 is used, so it is understood that only one pin 52 is necessary and that the pin and driver 20 may be positioned on either side of the frame 12. Similarly, retaining members 53 may be provided on one or both sides of the frame. The second pivot point is at flange bearing 54 affixed to the upper interior side of the front upright member 36 just above the transverse brace. The flange bearing 54 is preferably bolted to the upright member 36 rather than being welded to it or formed as an integral part of it, so that the flange bearing 54 may be easily replaced or repaired. Although a flange bearing 54 is preferred, it is understood that a simple bushing may be used instead or that simple metal to metal contact may also be used.

The mechanical linkages that move the toilet seat 16 between a lowered and raised position are best seen in FIGS. 5–7 and 11. A transverse member (FIG. 11) 56 is pivotally secured between flange bearings 54, and support arms 58 are rigidly affixed at their forward ends to the transverse member. The toilet seat 16 is secured to the shield 28, which is in turn supported and braced by longitudinal seat supports 60, one or more on each side. The shield 28 is shaped so that a back portion of the shield 28 extends above and rearward of a rear portion of the frame 12 when the toilet seat 16 is in the lowered position. This reduces the risk of pinching and injury that might otherwise arise if a user grasped the back portion of the toilet seat 16 rather than grasping the armrests 22. The rear ends of the support arms 58 are pivotally connected to the seat supports 60 with pins 64. The driver or linear actuator 20 is pivotally mounted to the frame at retaining members 53 by the pin 52. Any number of different drivers known in the art may be used, but a ball screw motor is preferred. One or more drivers may also be used. Although not shown, a power source may be required for the driver 20, such as a source of electric power. The type or form of power is not critical and will vary depending upon the driver selected. For example, if the driver 20 is of a 12-volt direct current type, a 12-volt gelcel type battery may be used. A charging system may be used to maintain the charge on the battery. As another example, a source of alternating current may be provided either directly to the driver 20 or indirectly using a voltage converter. The driver 20 includes a drive member 68. The drive member 68 is pivotally connected to the support arm 58 at a pin 72 disposed at an intermediate portion of the support arm 58. It is understood that the toilet seat 16 or shield 28 may be operably connected to the driver 20 in any number of different ways to achieve any number of different patterns of movement of the toilet seat 16 as the seat moves between a lowered and raised position. It is also understood that separate drivers may be used to raise and lower the toilet seat 16 and armrests 22. Also, although a lowered and raised position are described, it is understood that the toilet seat 16 and armrests 22 may be started and stopped at any number of different positions over their ranges of motion. Similarly, different users may raise and lower the toilet seat 16 and armrests 22 to different lowered and raised positions as desired.

Referring to FIGS. 5 and 8–10, each armrest 22 has a front member 24, a top portion 78, and a rear member 26. The armrest 22 is aligned so that the top portion 78 is disposed substantially horizontally and so that a substantial portion of the front and rear members 24 and 26 angle rearwardly from top to bottom, in parallel alignment with each other. It is understood that the top portion 78 and the portions of the front and rear members 24 and 26 adjacent thereto are preferably a single, unitary piece that is bent, swaged, or formed in a desired shape. An opening is provided in the armrest 22, preferably at the front of the top portion 78 or at the top of the front member 24. No pivot pins pass through a passageway 82 within the front member 24 so that a substantially unobstructed passageway is available within the front member 24 extending from the opening to an open bottom end of the front member 24. A cover or padded cover 84 may be affixed to the armrest 22, preferably to the top portion 78, the cover 84 having an opening at a front portion for receiving a rocker switch 86. Wiring or conductors 88 pass from the rocker switch 86, through the passageway 82, and to the driver 20. A front portion of the cover 84 angles upwardly at an acute angle so that, when the toilet seat 16 is disposed in the lowered position, the front portion is higher than the back portion. In the preferred embodiment, flexible, accordion style tubing 89 is used within the passageway to keep the wires 88 grouped together and to avoid the need for a grommet at the bottom of the front member 24.

Figure 10:
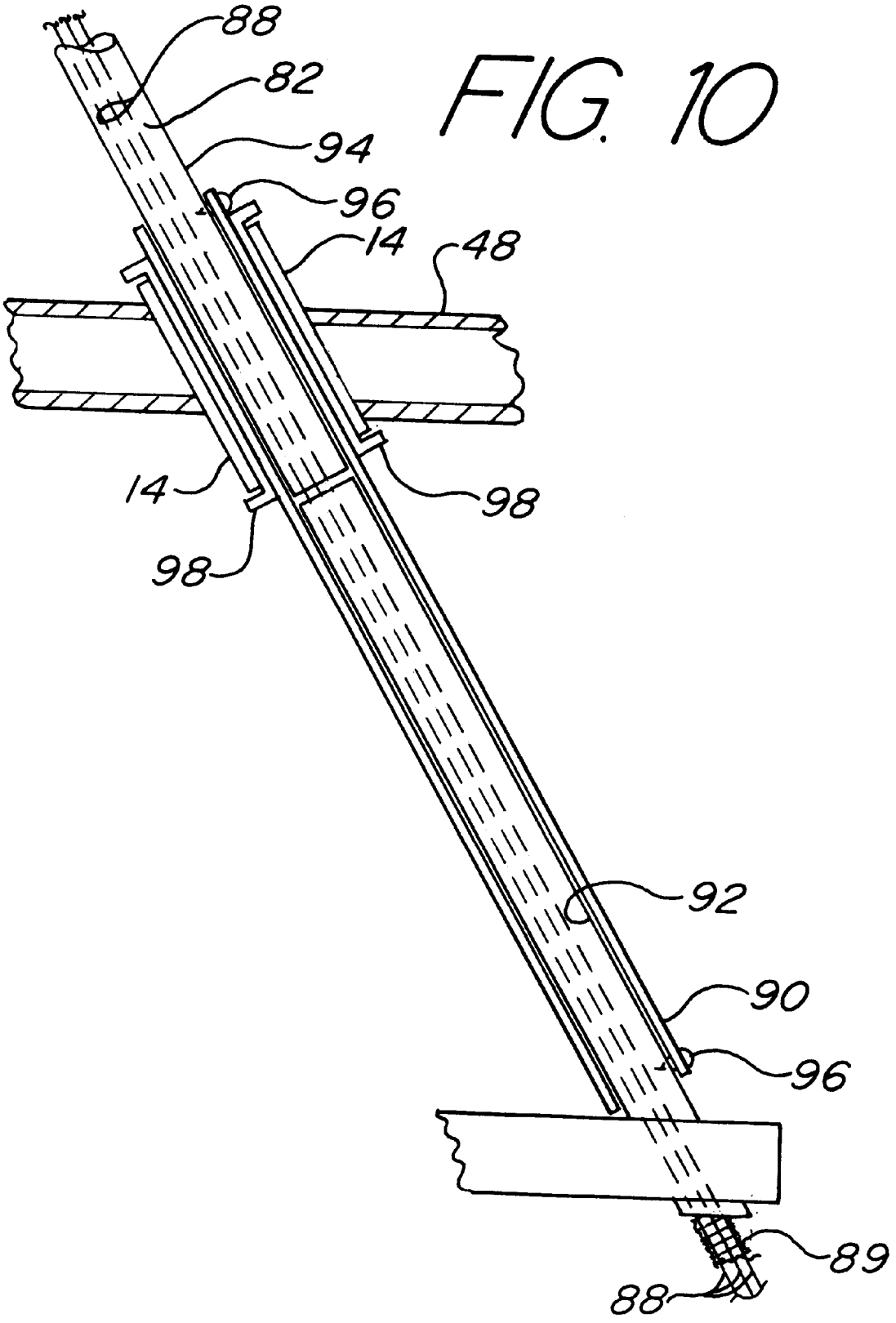
FIG. 10 is an enlarged, partially exploded view of a lower portion of an armrest of the present invention.

As best seen in FIG. 10, lower portions of the front and rear members 24 and 26 are preferably formed by an outer tube 90, a lower, inner tube 92, and an upper, inner tube 94. The outer tube 90 is preferably a stainless steel tube. An upper portion of the lower, inner tube 92 is disposed within the outer tube 90 and is rigidly secured thereto, such as by using a set screw 96. Similarly, a lower portion of the upper, inner tube 94 is disposed within the outer tube 90. The upper, inner tube may but need not be rigidly secured thereto using a set screw. The upper, inner tube 94 and lower, inner tube 92 abut one another within the outer tube 90 for added stability. Using this configuration has any number of advantages. For example, using upper, inner tubes 94 that are easily removable makes the apparatus 10 easier to ship in a more compact form. This also makes it much easier for a user to position the switch 86 on either armrest 22 as desired or to relocate the switch from one armrest 22 to the other. The relatively straight and substantially unobstructed passageway in the front members 24 also makes it easier to pass wiring 88 through the passageways 82 and therefore makes it easier to position the switch 86 on either armrest 22 as desired.

The mechanical linkages that move the armrests 22 between a lowered and raised position are best seen in FIGS. 5 and 8–10. Front and rear guides 14 are rigidly secured to each upper longitudinal brace 46. The guides 14 preferably pass through openings provided in the braces and have channels passing therethrough that are aligned to angle rearwardly from top to bottom. A bushing 98, such as a fiberglass impregnated bushing, is secured to each guide member and extends over all or a substantial length of each channel. The bushing 98 is preferably formed by upper and lower pieces. The bushing 98 and outer tube 90 are sized to permit the outer tube to slide through the bushing 98 as the toilet seat 16 and armrest 22 move between lowered and raised positions. The outer tube 90 has a length that is sufficient for portions of the outer tube 90 to extend both above and below the channel and bushing 98 over the entire range of motion of the armrest 22 as the armrest is moved between a raised and lowered position. Preventing any seams or junctions in the front member 24 from coming into contact with the bushing 98 as the armrest 22 slides through it provides for smoother operation and added durability. Although the guides 14 are depicted as being separate from and affixed to the frame 12, it is understood that the guides 14 and channels may be integrally formed with the frame 12 or may be nothing more than properly aligned holes in the upper and lower surfaces of the upper longitudinal braces 46. Further, although the guides 14 are described and depicted as passing through the upper longitudinal braces 46, the guides may be disposed alongside inner or outer surfaces thereof.

The front and rear armrest members 24 and 26 slidably pass through the bushings 98 and the front and rear channels. A spacing member 100 is rigidly secured to lower portions of the front and rear armrest members 24 and 26 for added strength and rigidity. A front coupling member 102 is pivotally connected at its lower end to a front end of the spacing member 100 at pin 104, in front of the point of attachment of the front member 24. The front coupling member 102 is pivotally connected at its upper end to a forward portion of the seat support 60 at pin 105. A rear coupling member 108 is pivotally connected at its lower end to an intermediate portion of the spacing member 100 at pin 110 and is pivotally connected at its upper end to support arm 58 at pin 72, the pin to which the driver 20 is also pivotally connected. The rear coupling member 108 is shorter than the front coupling member 102. The front and rear coupling members 102 and 108 are also configured to maintain the top portion 78 of the armrest 22 substantially horizontal as the armrest 22 moves between a lowered and raised position.

Figure 11:
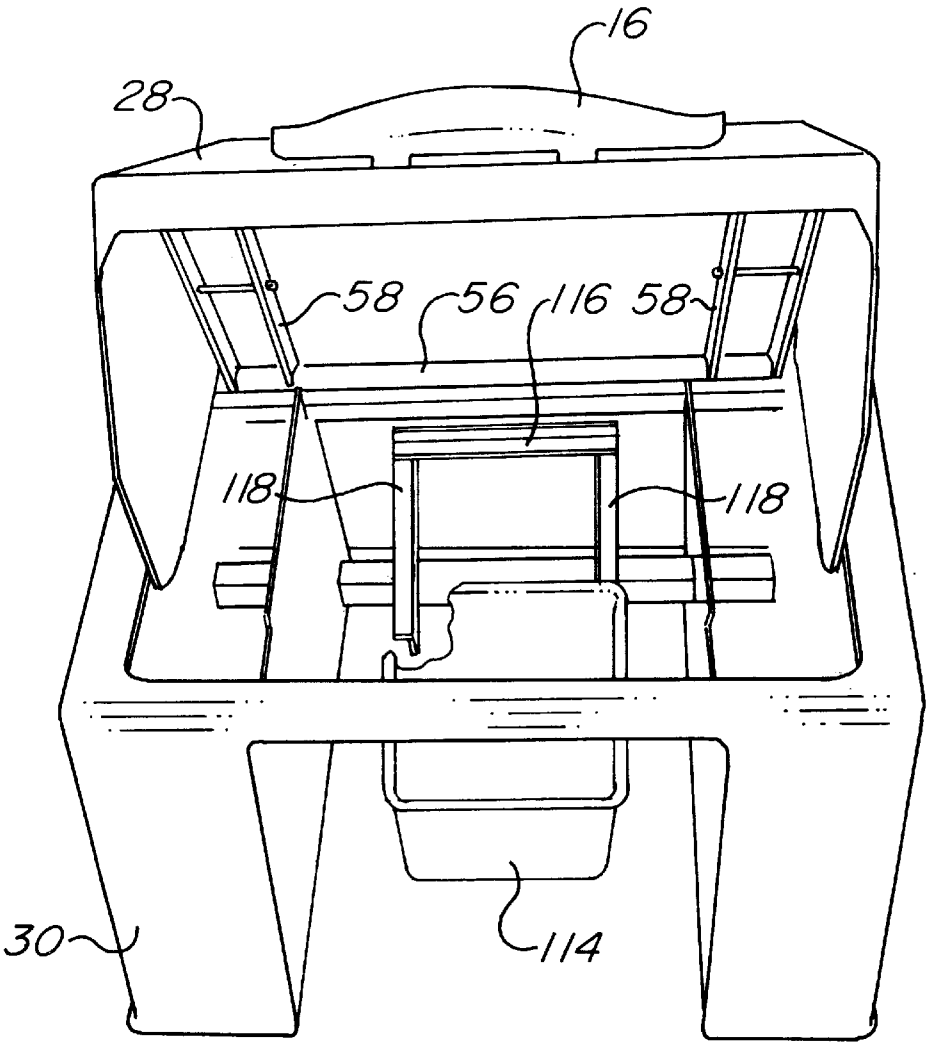
FIG. 11 is a partial, exploded rear view showing an alternate embodiment of the present invention.
Figure 7:
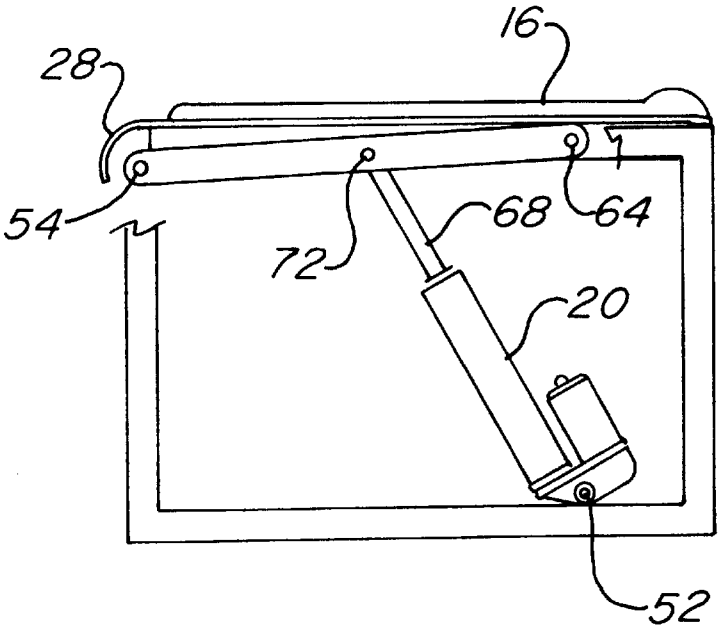
FIG. 7 is a partial left side elevation view showing a driver operably connected to a toilet seat in a lowered position.
Figure 8:
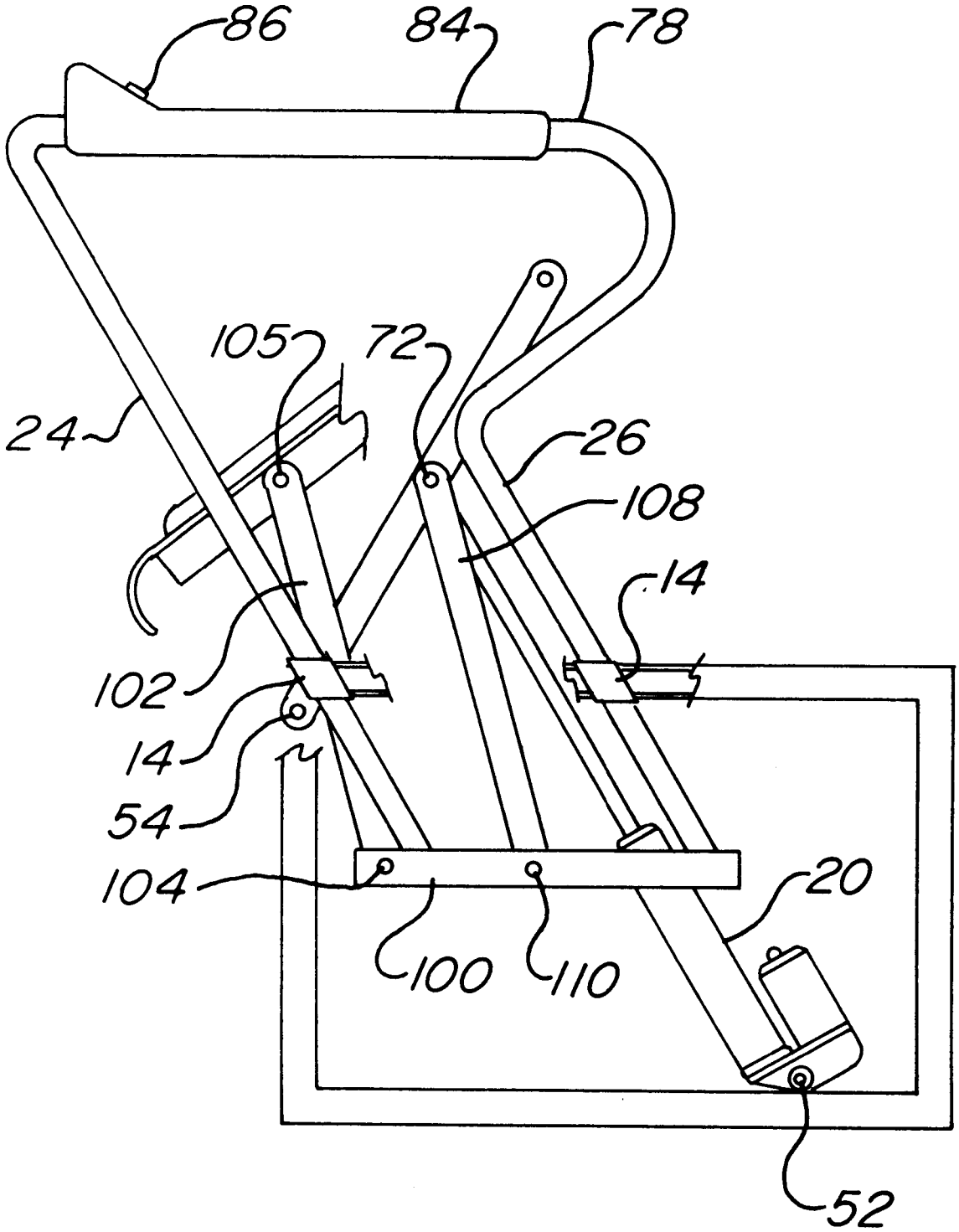
FIG. 8 is a partial left side elevation view showing a driver operably connected to an armrest in a raised position.
Figure 9:
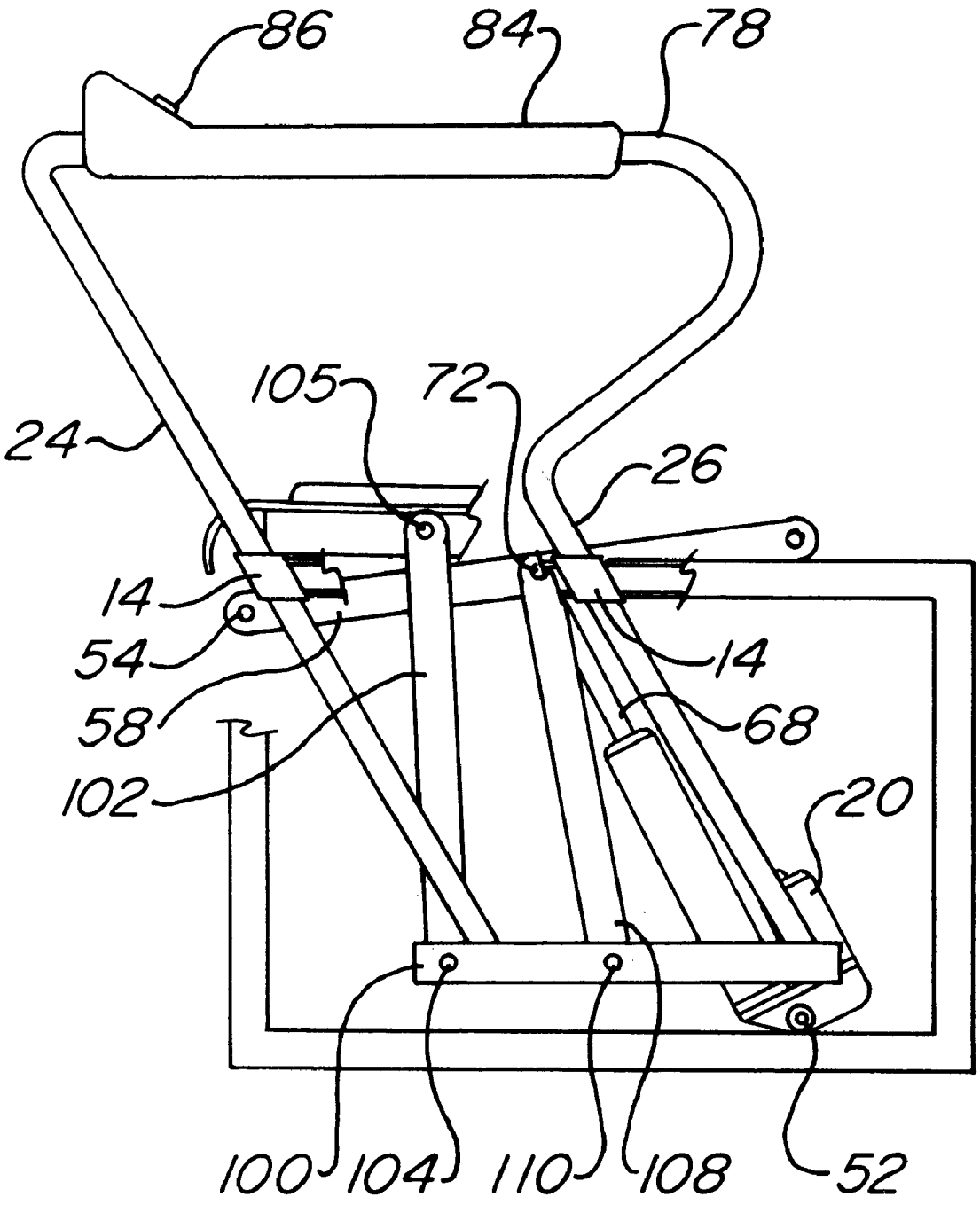
FIG. 9 is a partial left side elevation view showing a driver operably connected to an armrest in a lowered position.

FIG. 11 discloses an alternate embodiment in which a tub or receptacle 114 is provided to make the apparatus 10 a self-contained unit that may be used without the need for a toilet bowl. In this embodiment, angle irons 116 and 118 are secured to the frame 12 to provide supports for a removable tub or container. A front, transverse angle iron 116 rests on top of the upper front transverse brace 38, with a portion extending rearward of the brace 38. Two, longitudinal angle irons 118 are secured to angle iron 116 at right angles thereto and extend rearward from the angle iron 116 and brace 38 for supporting sides of the tub 114. The angle iron assembly simply slides or clamps over brace 38 and is easily placed on or removed from the brace 38 as desired. Lips or edges of the tub 114 rest primarily on the angle irons 118, and the tub may be easily slid along angle irons 118 to remove and replace the tub 114 for waste disposal and cleaning. Of course, for added flexibility, this apparatus 10 may be used, with the tub 114 in place, as a self-contained unit or may be used, without the tub and/or angle iron assembly, as a standard unit that is positioned over a toilet bowl. Also, it is understood that any number of configurations may be used for supporting the tub below the toilet seat 16.

In operation, the apparatus 10 is positioned over a toilet bowl 118, and the toilet seat 16 and armrests 22 are placed in raised positions using the rocker switch 86. In the raised position, the drive member 68 is extended, and the toilet seat 16 is tilted forward so that the back of the seat is higher than the front of the seat. The entire toilet seat 16 is also positioned slightly forward. A user positions himself or herself against the toilet seat 16, grasps the armrests 22, and actuates the rocker switch 86 to retract the drive member 68 thereby moving the toilet seat 16 and armrests 22 to lowered positions. As the drive member 68 retracts, the toilet seat 16 moves rearwardly and rotates clockwise until the seat supports 60 are adjacent the upper longitudinal braces 46 and the toilet seat 16 is substantially horizontal over the toilet bowl.

In the raised position, the armrests 22 are raised and are in a forward position making it easy for a user to grasp the armrests 22 when the user is in a standing position against the toilet seat 16, which is also in the raised position. The top portion 78 of the armrest 22 is substantially horizontal, thereby reducing the tendency of a user's hands to slip downward from the front of the armrests 22. The raised front portion of the padded cover 84 also reduces the risk of this happening. When the user actuates the switch 86 to retract the drive member 68, the armrests move downward and rearward in a linear motion as the front and rear members 24 and 26 of the armrests 22 slide through the angled channels of the front and rear guides 14. The top portions 78 of the armrests 22 remain substantially horizontal as the armrests move from the raised position to the lowered position. Because the driver 20 and rear coupling member 108 are both pivotally connected to the support arm 58, movement of the driver 20 simultaneously controls movement of the toilet seat 16 and of the armrests 22.

When a user is ready to return to a standing position, the user actuates the rocker switch 86 in the opposite direction so that the drive member 68 moves to an extended position. As the drive member 68 moves to an extended position, the toilet seat 16 and shield 28 move in a forward direction and rotate in a counter-clockwise direction to the raised position. Similarly, as the drive member 68 moves to an extended position, the armrests 22 move upward and forward in a linear motion. The top portions 78 of the armrests 22 remain substantially horizontal throughout its entire range of motion.

Other modifications, changes, and substitutions are intended in the foregoing, and in some instances, some features of the invention will be employed without a corresponding use of other features. For example, only one armrest may be used, and the armrest 22 may be used with or without the padded cover 84. Also, the apparatus 10 may be used with or without a backrest 32, a shroud 30, casters 34, and any number of other features. Further, although the toilet seat 16 is described as moving both forward and backward, and in a pivoting fashion, it is understood that any number of different patterns of seat movements may be used as the toilet seat 16 is moved between a lowered and raised position. Further still, bushings or bearings may be used in any of the holes, pivot points or locations where parts rotate, slide or move relative to one another. Accordingly, it is appropriate that the appended claims be construed broadly and in a manner consistent with the scope of the invention.

What is claimed is:

1. An apparatus, comprising:

a frame having a front and a back;

front and rear guides rigidly secured to said frame, said front and rear guides having front and rear channels, respectively, passing therethrough, said front and rear channels angling rearwardly from top to bottom;

a toilet seat, said toilet seat being operably connected to said frame and being movable between a lowered position and a raised position;

a driver operably connected to said toilet seat for moving said toilet seat between said lowered position and said raised position; and an armrest, said armrest comprising:

a front member slidably passing through said front channel; and a rear member slidably passing through said rear channel, said front and rear armrest members being operably connected to said driver for moving said front and rear armrest members through said front and rear channels as said armrest moves between a lowered position and a raised position and wherein said front and rear armrest members are operably connected to said driver by a linkage, said linkage comprising;

a first member rigidly secured to a lower portion of said front and rear armrest members;

a second member pivotally secured to said first member and operably connected to said toilet seat for pivotal motion relative to said toilet seat; and a third member pivotally secured to said first member and operably connected to said driver for pivotal motion relative to said driver.

2. The apparatus of claim 1, wherein said armrest further comprises a top portion, said top portion being disposed between said front and rear armrest members; and wherein said front and rear armrest members are operably connected to said driver so that said top portion of said armrest remains in a substantially horizontal position as said armrest moves between said lowered position and said raised position.

3. The apparatus of claim 1 wherein said third member is shorter than said second member.

4. The apparatus of claim 1, wherein said front armrest member comprises:

an outer tube;

a lower, inner tube, said lower, inner tube being rigidly secured to said outer tube and having an upper portion disposed within said outer tube; and an upper, inner tube, said upper, inner tube having a lower portion disposed within said outer tube.

5. The apparatus of claim 4, wherein said outer tube has a length selected so that an upper end of said outer tube remains disposed above an upper opening of said front channel as said armrest moves between said lowered position and said raised position.

6. The apparatus of claim 5, further comprising a bushing secured to said front guide and extending over a substantial length of said front channel, said outer tube being sized to slide through said bushing as said armrest seat moves between said lowered position and said raised position.

7. The apparatus of claim 1 wherein said front armrest member comprises a tube, said tube having an inner passageway, said inner passageway being unobstructed where said tube is secured to said first member.

8. The apparatus of claim 1, wherein said armrest further comprises a pad, said pad having a front and a back portion disposed so that when said toilet seat is in a lowered position, said back portion is substantially horizontal and said front portion extends higher than said back portion.

9. The apparatus of claim 8 wherein said front portion of said pad angles upwardly from said rear portion of said pad at an acute angle.

10. The apparatus of claim 9 further comprising a switch for actuating said driver, said switch being secured to said armrest and being disposed so that it extends through an opening in said front portion of said pad.

11. The apparatus of claim 1, further comprising:

a switch for actuating said driver, said switch being secured to said armrest; and a conductor extending between said switch and said driver;

said front member having a passageway, and said conductor passing through said passageway, said passageway being substantially straight over a substantial portion thereof and said passageway being substantially unobstructed over substantially its entire length.

12. The apparatus of claim 1, further comprising a shield, said shield being operably connected to said frame and said toilet seat being operably connected to said shield, said shield having a back portion, said back portion of said shield extending above and rearward of a rear portion of said frame when said toilet seat is in said lowered position.

13. The apparatus of claim 1, further comprising:

a flange bearing bolted to said frame;

a shield, said toilet seat being operably connected to said shield; and a support arm, said support arm being pivotally secured to said frame at said flange bearing and being operably connected to said shield for pivotal motion relative to said shield.

14. The apparatus of claim 1, further comprising: first, second, and third angle irons supported on said frame, said first angle iron being disposed in a transverse direction, and said second and third angle irons being secured to said first angle iron and extending in a longitudinal direction, rearward therefrom; and a tub, said tub sized to rest on said second and third angle irons below said toilet seat.

15. The apparatus of claim 1, wherein said driver is a ball screw motor.

16. An apparatus, comprising:

a frame;

a toilet seat operably connected to said frame;

means for moving said toilet seat between a lowered position and a raised position;

an armrest operably connected to said frame, said armrest having front and rear members, said front and rear members being in parallel alignment over a substantial portion of their lenghts;

means for moving said armrest in a linear path between a lowered position and a raised position, said raised position being forward of said lowered position; and power means, said power means being operably connected to said means for moving said toilet seat for pivotal movement relative thereto, and said power means being operably connected to said means for moving said armrest for pivotal movement relative thereto and wherein said means for moving said armrest comprises;

front and rear guides rigidly secured to said frame, said front and rear guides having front and rear channels, respectively, passing therethrough, said front and rear channels angling rearwardly from top to bottom;

a first member rigidly secured to a lower portion of said front and rear armrest members;

a second member pivotally secured to said first member and operably connected to said toilet seat for pivotal motion relative to said toilet seat; and a third member pivotally secured to said first member and operably connected to said power means for pivotal motion relative to said power means.

17. The apparatus of claim 16 wherein said second member is pivotally secured to a front portion of said first member and said third member is pivotally secured to an intermediate portion of said first member.

18. The apparatus of claim 17 wherein said third member is pivotally secured to said first member at a point between said front and rear armrest members.

* * * * *